US006668771B2

(12) United States Patent
Martinsson

(10) Patent No.: US 6,668,771 B2
(45) Date of Patent: Dec. 30, 2003

(54) TWO-STROKE INTERNAL COMBUSTION ENGINE

(75) Inventor: Pär Martinsson, Jönköping (SE)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 10/193,449

(22) Filed: Jul. 11, 2002

(65) Prior Publication Data

US 2003/0015153 A1 Jan. 23, 2003

Related U.S. Application Data

(63) Continuation of application No. PCT/SE00/00060, filed on Jan. 14, 2000.

(51) Int. Cl.[7] ..... F02B 33/04
(52) U.S. Cl. ..... 123/73 A; 123/73 PP
(58) Field of Search ..... 123/73 A, 73 PP

(56) References Cited

U.S. PATENT DOCUMENTS

| | | | |
|---|---|---|---|
| 968,200 | A | 8/1910 | Scott |
| 980,134 | A | 12/1910 | Springer |
| 1,113,456 | A | 10/1914 | McIntosh |
| 1,121,584 | A | 12/1914 | Harper, Jr. |
| 2,317,772 | A | 4/1943 | Huber et al. |
| 4,067,302 | A | 1/1978 | Ehrlich |
| 4,075,985 | A | 2/1978 | Iwai |
| 4,176,631 | A | 12/1979 | Kanao |
| 4,248,185 | A | 2/1981 | Jaulmes |
| 4,253,433 | A | 3/1981 | Blair |
| 4,306,522 | A | 12/1981 | Fotsch |
| 4,340,016 | A | 7/1982 | Ehrlich |
| 4,481,910 | A | 11/1984 | Sheaffer |
| 4,969,425 | A | 11/1990 | Slee |
| 4,987,864 | A | 1/1991 | Cantrell et al. |
| 5,379,732 | A | 1/1995 | Mavinahally et al. |
| 5,425,346 | A | 6/1995 | Mavinahally et al. |
| 5,645,026 | A | 7/1997 | Schlessmann |
| 5,857,450 | A | 1/1999 | Staerzl |
| 6,016,776 | A | 1/2000 | Jonsson |
| 6,085,703 | A | 7/2000 | Noguchi |
| 6,112,708 | A | 9/2000 | Sawada et al. |
| 6,216,650 | B1 | 4/2001 | Noguchi |
| 6,240,886 | B1 | 6/2001 | Noguchi |
| 6,289,856 | B1 | 9/2001 | Noguchi |

FOREIGN PATENT DOCUMENTS

| | | |
|---|---|---|
| DE | 420 100 | 10/1925 |
| DE | 470 603 | 1/1929 |
| DE | 748 415 | 11/1944 |
| DE | 749 456 | 11/1944 |

(List continued on next page.)

OTHER PUBLICATIONS

The Villiers Engineering Company Limited, Jul. 27, 1935, p. 1, figures 1–6 (FR 784866).
Fichtel & Sachs Aktiengesellschaft, Feb. 28, 1966, p. 1, line 15–34, figures. 1,2 (FR 1434710A).
Patents Abstracts of Japan, Publication No 07–269356, published Oct. 17,1995.

(List continued on next page.)

*Primary Examiner*—Noah P. Kamen
(74) *Attorney, Agent, or Firm*—Pearne & Gordon LLP

(57) ABSTRACT

The invention relates to a crankcase scavenged internal combustion engine (1) of two-stroke type, comprising a cylinder (2) with an inlet tube (10) for air/fuel mixture and a number of transfer ducts (20), a carburetor (12) connected to the inlet tube (10), and an air inlet (24) provided with a restriction valve (25) whereby a piston ported air passage (23, 22, 26, 21) is arranged between the air inlet (24) and the upper part of the transfer ducts (20). The engine's air inlet (24) extends at least partly below and outside the carburetor (12), resulting in a more compact engine design and improved use of the space around the cylinder. Moreover, the cooling air gets better access to the cylinder.

10 Claims, 1 Drawing Sheet

FOREIGN PATENT DOCUMENTS

| | | | |
|---|---|---|---|
| DE | 2 151 941 | | 4/1973 |
| DE | 26 50 834 | A1 | 6/1977 |
| DE | 33 29 791 | A1 | 2/1985 |
| DE | 37 22 424 | A1 | 1/1988 |
| DE | 198 57 738 | A1 | 7/1999 |
| EP | 0 337 768 | | 10/1989 |
| EP | 0 391 793 | A1 | 10/1990 |
| EP | 0 971 110 | A1 | 1/2000 |
| EP | 0 997 620 | A2 | 5/2000 |
| FR | 784 866 | | 7/1935 |
| FR | 434 710 | | 2/1966 |
| GB | 2 022 699 | | 12/1979 |
| GB | 0 130 642 | | 6/1984 |
| GB | 0 337 768 | | 10/1989 |
| GB | 0 391 793 | | 10/1990 |
| JP | 2000-170611 | | 6/2000 |
| JP | 2000-328945 | | 11/2000 |
| JP | 2000-337154 | | 12/2000 |
| WO | WO 89/02031 | | 3/1989 |
| WO | WO98/57053 | | 12/1998 |
| WO | WO 98/57053 | | 12/1998 |
| WO | WO 00/65209 | | 11/2000 |
| WO | WO 01/25604 | | 4/2001 |
| WO | WO 01/44634 | | 6/2001 |

OTHER PUBLICATIONS

Lenz, Bruner, Gerstl 1978, Paper Wien University, side 1–16, table I–III, Picture 1–17, (English explanation of relevance is attached).

Dr. R. Pischinger, 5th Graz Two–Wheeler Symposium, Apr. 1993.

Friedrich Gerstl, Dissertation: Massnahmen Zur Abgas–Und Verbrauchsverbesserung Von Kleinvolumigen Zweitakt–Ottomotoren, Aug. 1979, (English explanation of relevance is attached).

J. Meyer, Air–Head Charge Stratification of a Two–Stroke Outboard Engine, Queens University of Belfast, Mar. 27, 1992.

TWO-STROKE INTERNAL COMBUSTION ENGINE

This application is a Continuation of international application PCT/SE00/00060 filed on Jan. 14, 2000.

TECHNICAL FIELD

The subject invention relates to a crankcase scavenged internal combustion engine of two-stroke type, in which a piston ported air passage is arranged between an air inlet and the upper part of a number of transfer ducts. Fresh air is added at the top of the transfer ducts and is intended to serve as a buffer against the air/fuel mixture below. Mainly this buffer is lost out into the exhaust outlet during the scavenging process. The fuel consumption and the exhaust emissions are thereby reduced.

BACKGROUND OF THE INVENTION

For engines of the above-mentioned kind usually the air inlet of the cylinder is connected via a restriction valve to the air filter of the engine. The restriction valve is arranged, by means of one or several engine parameters, to regulate the intake of air into the transfer ducts. Below the air inlet the inlet tube of the cylinder is connected to the carburetorurettor, whose air inlet debouches into the air filter to the side of said restriction valve.

In order to keep the height of the engine design down it is preferable that the inlet tube is directed as horizontally as possible. It should however not be angled downwards from the cylinder, since there is a risk that the fuel mixture, at idling, will flow backwards into the carburetor from the cylinder, resulting in uneven engine running or possibly engine stop.

These demands on the inlet tube's orientation, and combined with that these carburetors of prior art technology often extend a bit more vertically in relation to the diameter of the inlet tube, will result in that the air inlet, located above the inlet tube, after all is located relatively high up in the engine. This leads to problems, especially when the engine is applied for handheld tools, e.g. chain saws or grass trimmers, since they might get a clumsy and unpractical design. Moreover, the high located air inlet would easily restrict the cooling air of the cylinder, with reduced cooling of the cylinder as a result.

In order to minimize these disadvantages the inlet tube is usually directed as horizontally as possible without running the risk of engine stop, and this orientation is not optimal.

SUMMARY OF THE INVENTION

The purpose of the subject invention is to solve the above-mentioned problems and to achieve a crankcase scavenged two-stroke engine having such a design that the height of the engine would not lead to any problems when using the engine in handheld engine tools.

This purpose is achieved by an engine of the previous mentioned kind according to the invention, in which the air inlet at least partly extends below the carburetor. Since the connecting ports for fresh air on the inside of the cylinder have a predestinated location above the inlet in order to achieve the desired piston porting, this means that the air inlet has to cross the inlet tube, e.g. by arranging external air ducts, such as hoses or tubes, between the cylinder and the air inlet located below the carburetor.

Often there is at least one connecting port on each side of the cylinder, and via air ducts, which extend passing the inlet tube, the connecting ports can be connected to a common air inlet.

This location of the air inlet is thus completely inverted in relation to known engine design and creates a number of advantages.

In the first place the whole engine design will become more compact thanks to a more optimal use of the space to the side of the cylinder.

In the second place the air is forced to flow through the air inlet from a position below the carburetor and inlet tube, thereby allowing a more favourable flow direction into the engine.

In the third place the cooling air will be given better access to the cylinder since the air inlet is located at a greater distance from the cooling fins. The fact is that the whole air filter can be located at a greater distance from the cylinder, which also improves the inflow of cooling air.

Furthermore, according to a particularly preferred embodiment the air inlet is connected to the cylinder at a mouth below the inlet tube. This is an advantage, since the demand for a connection above the inlet tube will be totally eliminated, thereby the location and orientation of the inlet tube can be chosen more freely. Owing to this design also the demand for external air ducts passing the inlet tube would be eliminated, and a more compact and space-saving solution is created. At the same time the air flow through the air inlet will be improved even more and the demand for sharp bends in the air inlet will be eliminated.

Preferably the inlet tube is directed obliquely upwards in a direction away from the cylinder, and preferably the carburetor is located in the prolongation of the inlet tube. This higher up location of the carburetor in the engine will create more space for the air inlet located below the carburetor. Furthermore, the intake flow of air/fuel-mixture is forced to flow directly downwards into the crankcase, thereby lubricating the piston rod bearing.

The air inlet can extend partly on the outside of the carburetor, so that the restriction valve, which usually is arranged at the end of the air inlet, will be located essentially aligned with the air inlet of the carburetor. This design makes it possible to use a straight filter stud between carburetor and filter, resulting in reduced throttling of the air and improved delivery to the engine.

Owing to the orientation of the inlet tube and the carburetor the restriction valve can be located above the carburetor, or at the same level as it. However, it can as well be located obliquely above or obliquely below the carburetor. In case a common air filter is used this relation will affect the orientation of the air filter, which is made to align with the neighbouring parts in an optimal way.

BRIEF DESCRIPTION OF THE DRAWINGS

The subject invention will be described in closer detail in the following with reference to the accompanying drawing, whose only figure for the purpose of exemplifying is showing a basic outline of an engine according to a preferred embodiment of the invention.

DESCRIPTION OF A PREFERRED EMBODIMENT

Figure 1:
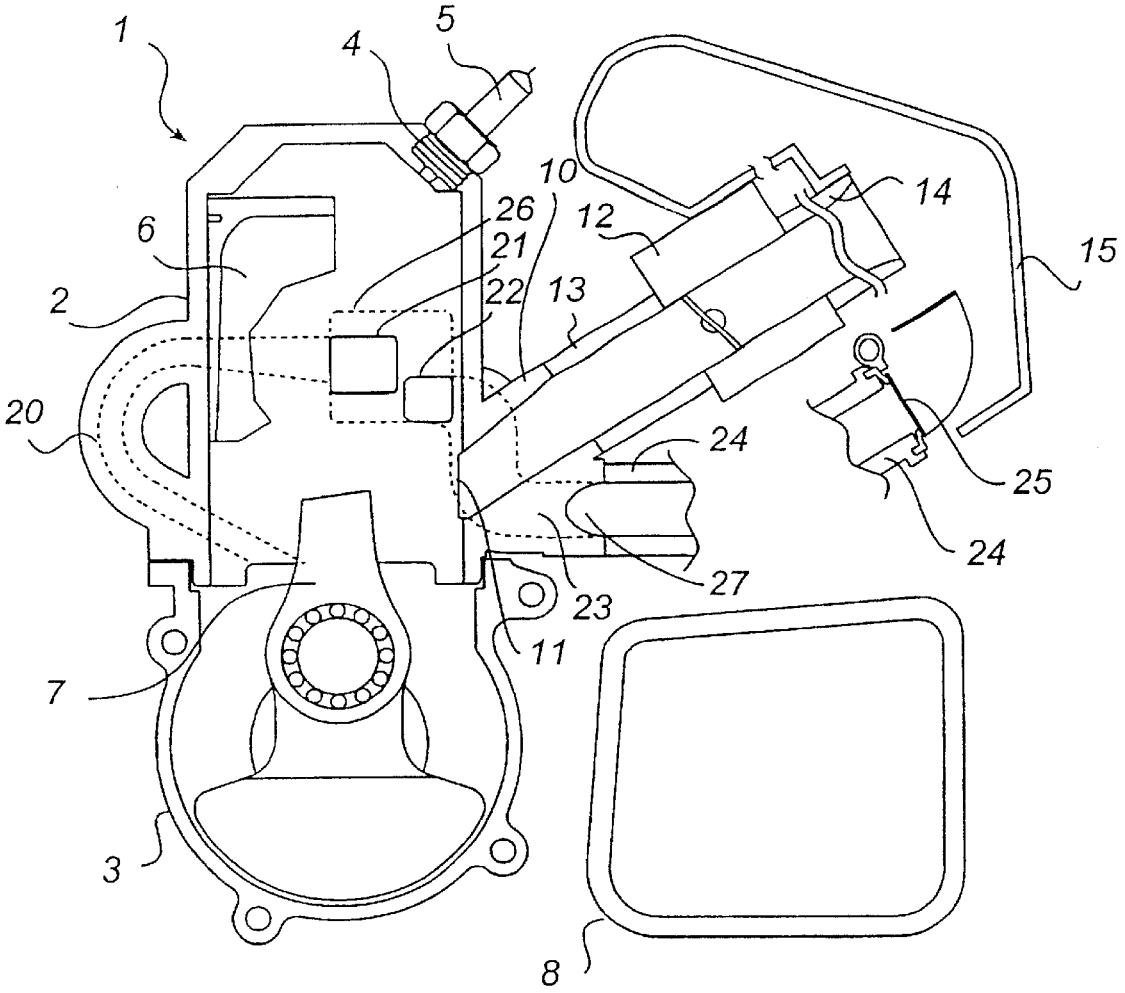

The crankcase scavenged internal combustion engine of two-stroke type as shown in the figure is generally designated by numeral reference 1 and comprises a cylinder 2, which is mounted to a crankcase 3. In an attachment 4 on the outside of the cylinder a spark plug 5 is arranged. In the cylinder extends a piston 6, to which a piston rod 7 is arranged. In the figure the piston and piston rod are partly cut away, for the purpose of showing other parts of the engine more clearly. By numeral reference 8 a schematically shown fuel tank is designated, only shown for the purpose of illustrating its location in relation to the engine 1 in a handheld power tool, such as a chain saw. Obviously, the cylinder also has an exhaust outlet connected to a muffler, which for the sake of clarity is not at all shown in the drawing.

The following description refers in the first place to the parts, which are related to the subject invention. The remaining parts of the engine and its general function might be regarded as well known for the skilled man so that a more detailed description thereof would not be necessary.

It is here to be noted that the orientation of the engine according to the present description, generally is that the crankcase is directed downwards and the spark plug upwards. Normally there should not exist any major variations from this orientation, however, this orientation should nevertheless not be regarded as a limitation of the subject invention, which rather relates to the relative design and the location of the different parts of the engine.

The cylinder 2 is equipped with an inlet tube 10, which in the cylinder debouches into an inlet port 11. Via the inlet tube the cylinder is supplied with air/fuel mixture from a carburetor 12. An intermediate connection 13 is arranged between the carburetor 12 and the inlet tube 10 to enable a relatively free location of the carburetor. Furthermore the carburetor has an air inlet 14, which is arranged to take air from an air filter 15.

Furthermore, the cylinder 2 has one or several transfer ducts, or scavenging ducts 20, each of them having a scavenging port 21 that debouches into the cylinder. The scavenging ducts can be arranged radially outwards from the cylinder in the conventional way, or, as shown in the figure, be arranged tangentially from the scavenging ports 21. The scavenging ducts 20 connect the scavenging ports to the crankcase 3.

Close to each scavenging port 21, and located somewhat further down along the cylinder wall, a connecting port 22 for fresh air is arranged. Each connecting port 22 is via a connecting duct 23 connected to an air inlet 24, which at its other end is equipped with a restriction valve 25.

During running of the engine 1, which will not be described in closer detail here, the connecting ports 22 will be connected to the scavenging ports 21 via a recess in the piston. This recess is illustrated as a dashed square 26 in the figure. Thereby fresh air can flow through the air inlet 24 into the scavenging ducts 20.

The air inlet 24 extends from a point below the inlet tube 10 away from the cylinder 2, i.e. below the carburetor 2. The air inlet then makes a bend slightly upwards, so that the restriction valve 25 becomes located obliquely below and in line with the air inlet 14 of the carburetor 12, as shown in the figure. However, in the figure the air inlet 24 is broken, in order to mark out that this positioning of the restriction valve 25 is only an example. Both shorter as well as longer air inlets 24 could be relevant, whereas the restriction valve 25 could be located either directly below the carburetor, or completely outside the carburetor 12 (to the right in the figure), or even above the carburetor 12.

The carburetor 12 and its air inlet 14 are in the figure located in the prolonging direction of the inlet tube 10. However, it is quite possible to choose another positioning of the carburetor, and in particular the air inlet 14 could have a different run, which is also marked out in the figure by broken lines.

Since both the air inlet 14 of the carburetor and the restriction valve 25 normally both are connected to the air filter 15, the design of the engine will be an interplay between these parts. The solution as shown in the figure will result in relatively straight inlets for the air both through the carburetor 12 and through the air inlet 24 as well as in an angled orientation of the common air filter 15. Owing to surrounding constructions in the work environment of the engine other embodiments could as well be more optimal, and the air inlet 24 would not necessarily connect to the air filter 15.

As shown in the example the connecting ducts 23 can be embodied of pre-cast ducts through the cylinder material, which connect to a common outer connecting port 27 located below the inlet tube 10. However, they could as well be embodied of tubes or hoses extending between the connecting ports 22 and the air inlet 24, via some kind of Y-connection.

To sum up it can be noted that the above description of an embodiment of the invention is only to be regarded as an example, and that a number of modifications would be possible within the scope of the appended patent claims.

What is claimed is:

1. A two-stroke, crankcase-scavenged internal combustion engine (1) including:

a cylinder (2);

an inlet tube (10) operatively connected to the cylinder (2) for introducing air/fuel mixture to the cylinder (2);

a transfer duct (20) extending from the cylinder (2) to a crankcase (3) area of the engine (1), the crankcase (3) being located toward a lower portion of the engine (1);

a carburetor (12) connected to the inlet tube (10); and an air inlet (24) equipped with a restriction valve (25);

a piston-ported air passage (23, 22, 26, 21) arranged between the air inlet (24) and the transfer duct (20) at the cylinder (2):

wherein the inlet tube (10), the carburetor (12), the air inlet (24), and the air passage (23, 22, 26, 21) are configured with respect to the engine (1) such that the air inlet (24) at least partly extends below the carburetor (12).

2. An engine as set forth in claim 1, wherein the air inlet (24) extends to connect with the piston-ported air passage (23, 22, 26, 21) at a location below the inlet tube (10) with respect to the engine (1).

3. An engine as set forth in claim 1, wherein the inlet tube (10) is directed obliquely upwards in a direction away from the cylinder (2) with respect to the engine (1), and the carburetor (12) is located at the distal end portion of the inlet tube (10) from the cylinder (2).

4. An engine as set forth in claim 1, wherein the air inlet (24) at least partly extends beyond the location of the carburetor (12) with reference to the cylinder (2).

5. An engine as set forth in claim 1, wherein the restriction valve (25) is located below the carburetor (12) with respect to the engine (1).

6. An engine as set forth in claim 1, wherein the restriction valve (25) is located further from the cylinder (2) than the carburetor (12).

7. A two-stroke, crankcase-scavenged internal combustion engine (1) including:

a cylinder (2) having a cylinder axis extending to a crankcase (3);

an inlet tube (10) operatively connected to the cylinder (2) for introducing air/fuel mixture to the cylinder (2);

a transfer duct (20) extending from the cylinder (2) to a crankcase (3) area of the engine (1), the crankcase (3) being located toward a lower portion of the engine (1);

a carburetor (12) connected to the inlet tube (10); and an air inlet (24) equipped with a restriction valve (25);

a piston-ported air passage (23, 22, 26, 21) arranged between the air inlet (24) and the transfer duct (20) at the cylinder (2):

wherein the inlet tube (10), the carburetor (12), the air inlet (24), and the air passage (23, 22, 26, 21) are configured with respect to the engine (1) such that the air inlet (24) is closer to the crankcase (3) than the carburetor (12) along the direction of the cylinder axis.

8. A two-stroke, crankcase-scavenged internal combustion engine (1) including:

a cylinder (2) having a stroke axis;

an inlet tube (10) operatively connected to the cylinder (2) for introducing air/fuel mixture to the cylinder (2);

a transfer duct (20) extending from the cylinder (2) to a crankcase (3) area of the engine (1);

a carburetor (12) connected to the inlet tube (10); and an air inlet (24) equipped with a restriction valve (25);

a piston-ported air passage (23, 22, 26, 21) arranged between the air inlet (24) and the transfer duct (20) at the cylinder (2):

wherein the inlet tube (10), the carburetor (12), the air inlet (24), and the air passage (23, 22, 26, 21) are configured with respect to the engine (1) such that air flowing through the air inlet (24) and the air passage (23, 22, 26, 21) traverses from one side of inlet tube (10) and the carburetor (12) to another side of the inlet tube (10) and the carburetor (12) along the direction of the cylinder stroke axis.

9. An engine as set forth in claim 8, wherein the inlet tube (10), the carburetor (12), the air inlet (24), and the air passage (23, 22, 26, 21) are configured such that the air flow traverses upward from below the inlet tube (10) and the carburetor (12) past the inlet tube (10) and the carburetor (12).

10. An engine as set forth in claim 8, wherein the air passage (23, 22, 26, 21) includes a connecting duct (23) connected to the air inlet (24), a connecting port (22) connected to the connecting duct (23), a port (21) connected to the transfer duct (20), and a cylinder recess (26) that provides for air communication between the ports (22, 21), the cylinder recess (26) being located further away from the crankcase (3) than the location at which the inlet tube (10) is connected to the cylinder (2).

* * * * *

UNITED STATES PATENT AND TRADEMARK OFFICE

CERTIFICATE OF CORRECTION

PATENT NO. : 6,668,771 B2
DATED : December 30, 2003
INVENTOR(S) : Pär Martinsson It is certified that error appears in the above-identified patent and that said Letters Patent is hereby corrected as shown below:

Title page,
Item [56], References Cited, FOREIGN PATENT DOCUMENTS, please delete "FR 434 710 2/1966", and insert therfor -- FR 1 434 710 2/1966 --.

Signed and Sealed this

Fifteenth Day of June, 2004

JON W. DUDAS
*Acting Director of the United States Patent and Trademark Office*